US011457689B2

(12) United States Patent
Oroszi

(10) Patent No.: US 11,457,689 B2
(45) Date of Patent: Oct. 4, 2022

(54) SPORTS SHOE WITH A PATTERN FACILITATING BALL HANDLING

(71) Applicants: Lászió Oroszi, Vál (HU); Mihály István Lantos, Budapest (HU); István Márton, Budaörs (HU); Béla Tóth Balogh, Budapest (HU); Miklós Koszta, Budapest (HU)

(72) Inventor: Lászió Oroszi, Val (HU)

( * ) Notice: Subject to any disclaimer, the term of this patent is extended or adjusted under 35 U.S.C. 154(b) by 0 days.

(21) Appl. No.: 17/055,781

(22) PCT Filed: May 9, 2019

(86) PCT No.: PCT/HU2019/050022
§ 371 (c)(1),
(2) Date: Nov. 16, 2020

(87) PCT Pub. No.: WO2019/220157
PCT Pub. Date: Nov. 21, 2019

(65) Prior Publication Data

US 2021/0227924 A1 Jul. 29, 2021

(30) Foreign Application Priority Data

May 16, 2018 (HU) ..... P1800163

(51) Int. Cl.
*A43B 5/02* (2006.01)
*A43B 23/02* (2006.01)

(52) U.S. Cl.
CPC ..... *A43B 5/025* (2013.01); *A43B 23/0235* (2013.01)

(58) Field of Classification Search
CPC ..... A43B 5/00; A43B 5/001; A43B 5/008; A43B 5/002; A43B 5/025; A43B 5/06;
(Continued)

(56) References Cited

U.S. PATENT DOCUMENTS 9,380,834 B2 * 7/2016 Rushbrook ..... A43B 5/025
D791,450 S * 7/2017 Birkinhead ..... D2/902
(Continued)

FOREIGN PATENT DOCUMENTS

DE 202010017958 U1 6/2013
EP 2338371 A1 6/2011
(Continued)

*Primary Examiner* — Shaun R Hurley
*Assistant Examiner* — Bao-Thieu L Nguyen
(74) *Attorney, Agent, or Firm* — Handal & Morofsky LLC; Anthony H Handal

(57) ABSTRACT

Sports shoe with a pattern facilitating ball handling, wherein the surface of the upper of the sports shoe is divided into a plurality of shooting zones, and at least one of said shooting zones comprises a plurality of parts that extend out from the basic surface (21) of the upper and having elevated outer surfaces (22) that have increased grip to the ball, and these parts are spaced from each other and designed as directing isles (20) that have elongated shapes resembling to a rhombus or an almond shape and each has a longitudinal central axis (27) at the end of which respective apexes (25, 26) are formed that have angles smaller than 45°, each directing isle (20) has a transverse axis (28) extending where the isle has the highest width, and said apexes (25, 26) are connected with the ends of the transverse axis (28) by respective sides (a1, a2 and b1, b2) of the directing isle (20), the oppositely located sides (a1, a2 and b1, b2) are either straight or being slightly curved but their main directions are either parallel or close only a small angle, and the neighbouring directing isles (20) are arranged so that they are shifted from each other along the direction of their central axes (27) and between corresponding sides (a1 and a2) of a directing isle and the similarly directed sides (b1, b2) of a neighbouring directing isle directing channels (A and B) are formed that have directions closing with each other an acute angle, and the
(Continued)

width of the channels is between 4 and 15 mm and the height of the directing isles (20) from the basic surface (21) is between 0.4 and 3 mm.

15 Claims, 4 Drawing Sheets

(58) Field of Classification Search
CPC .... A43B 5/08; A43B 5/10; A43B 5/18; A43B 5/02; A43B 23/0235
See application file for complete search history.

(56) References Cited

U.S. PATENT DOCUMENTS

| | | | | |
|---|---|---|---|---|
| 10,238,171 | B2 * | 3/2019 | Mokos | A43B 23/0235 |
| 10,624,418 | B2 * | 4/2020 | Mokos | A43B 9/04 |
| 2004/0088888 | A1 * | 5/2004 | Johnston | A43B 5/025 36/133 |
| 2005/0016023 | A1 * | 1/2005 | Burris | A43B 7/08 36/45 |
| 2006/0117600 | A1 * | 6/2006 | Greene | B29D 35/126 36/9 R |
| 2009/0007457 | A1 | 1/2009 | Skirrow | |
| 2010/0077637 | A1 * | 4/2010 | Hatzilias | A43B 3/0042 36/133 |
| 2010/0299967 | A1 * | 12/2010 | Atsumi | A43B 5/025 36/133 |
| 2011/0247240 | A1 * | 10/2011 | Eder | A43B 5/00 36/133 |
| 2011/0258883 | A1 * | 10/2011 | Eder | A43B 5/025 36/133 |
| 2012/0233888 | A1 * | 9/2012 | Baker | A43B 5/025 36/133 |
| 2013/0074374 | A1 * | 3/2013 | Droege | A43B 23/0265 36/133 |
| 2013/0125417 | A1 * | 5/2013 | Minami | A43B 23/088 36/83 |
| 2015/0201705 | A1 * | 7/2015 | Doremus | D06M 23/16 36/45 |
| 2016/0095389 | A1 * | 4/2016 | Minami | A43B 7/146 36/45 |
| 2016/0143395 | A1 * | 5/2016 | Van Atta | A43B 23/0235 36/48 |
| 2016/0227881 | A1 * | 8/2016 | Beers | B32B 3/10 |
| 2017/0208896 | A1 * | 7/2017 | Mokos | A43B 13/223 |
| 2017/0208897 | A1 * | 7/2017 | Mokos | A43B 13/223 |
| 2017/0238658 | A1 * | 8/2017 | Gu | A43B 23/08 |
| 2017/0348935 | A1 * | 12/2017 | Leimer | A43B 23/026 |
| 2017/0360140 | A1 * | 12/2017 | Siegismund | A43B 1/04 |
| 2018/0103728 | A1 * | 4/2018 | Koo | A43D 8/16 |
| 2018/0153257 | A1 * | 6/2018 | Chang | A43C 11/14 |
| 2019/0053569 | A1 * | 2/2019 | Johnson | A43C 1/00 |
| 2019/0328075 | A1 * | 10/2019 | Poulsen | A43B 23/0265 |
| 2020/0015542 | A1 * | 1/2020 | Hsu | A43B 23/022 |
| 2020/0196707 | A1 * | 6/2020 | Toronjo | B32B 7/035 |
| 2020/0214390 | A1 * | 7/2020 | Mokos | A43B 13/223 |
| 2021/0100315 | A1 * | 4/2021 | Nguyen | B32B 7/12 |
| 2021/0204640 | A1 * | 7/2021 | Oroszi | A43B 5/025 |

FOREIGN PATENT DOCUMENTS

| | | | |
|---|---|---|---|
| FR | 2917273 | A1 | 12/2008 |
| GB | 202859 | A | 8/1923 |
| JP | H08332101 | A | 12/1996 |
| JP | H0928412 | | 2/1997 |
| KR | 2003003797 | A | 5/2003 |
| WO | 2010055276 | A1 | 5/2010 |

* cited by examiner

Fig.6
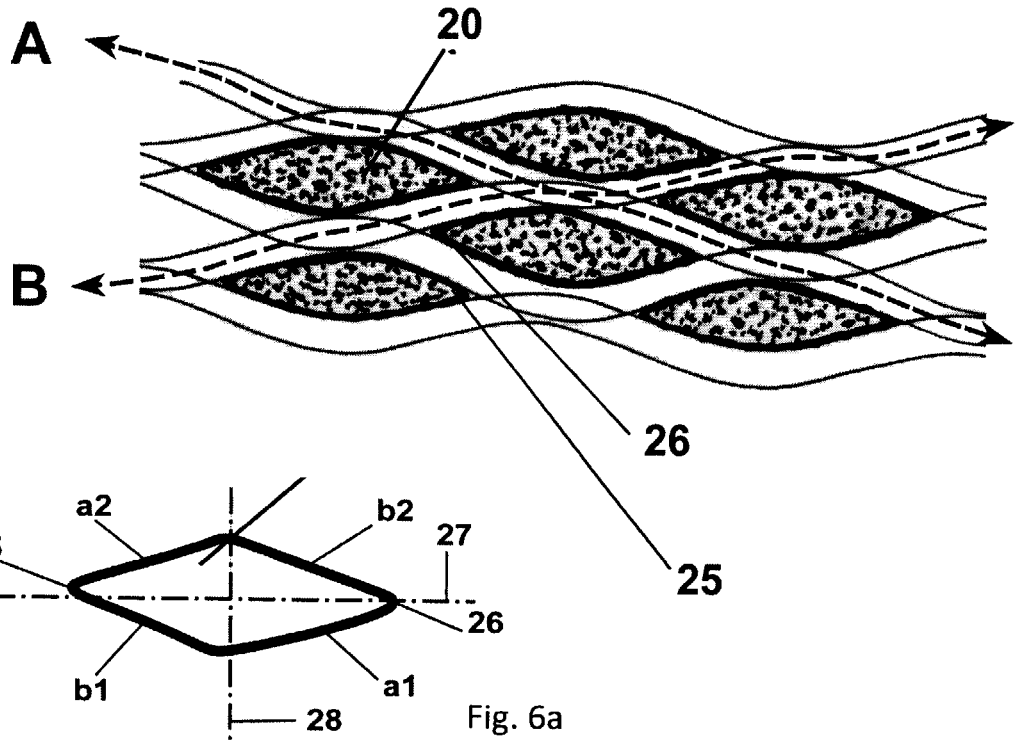
Fig. 6a
Fig. 7
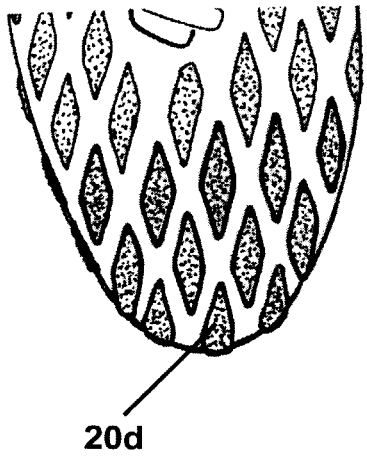

SPORTS SHOE WITH A PATTERN FACILITATING BALL HANDLING

The invention relates to a sports shoe with a pattern facilitating ball handling, wherein the surface of the upper of the sports shoe is divided into a plurality of shooting zones, namely at least into a nose zone, an inner and an outer shooting zone, and at least one of said shooting zones comprises a plurality of parts that extend out from the basic surface of the upper and have elevated outer surfaces that have increased grip to the ball, and these parts are spaced from each other.

The design of the outer surface of sports shoes that can provide optimum ball handling is a task known for a long time, and there are several ways how this task can be solved.

In my European patent EP 0948269 on the shooting surface of the sport shoe the use of ribbing was suggested for improving ball handling wherein the ribs were arranged in different directions. In case the ball arrived normal to the direction of the ribs, then by utilizing the law of reflections the edges of the ribs forwarded the ball towards the target with high force and spin. To that end the ribs had to be arranged so that possibly on all surface parts the direction of the ribs had to extend normal to the required shooting direction of the given surface part. This condition cannot be fully met because the shoe upper does not have a single surface part where the player wishes to kick the ball only into a single direction. A further problem arose from the hard design of the upper of the shoe because the ribs were provided on a thin rubber sheet and these cannot follow the shape of the bare foot as exactly and accurately as the thin leathers and leatherettes used nowadays.

A similarly designed ribbing was provided on the sports shoes sold under the commercial name "Predator Mania®" of the German company Adidas AG, but here the ribbing was provided only on the inner shooting zone of the shoes.

In the document US 2009/0009457 for improving the grip between the shoe surface and the ball numerous solutions were suggested and described a number of different plastic compounds and compositions that provide increased grip to the ball both under dry and wet conditions compared to customary leather or plastic shoe materials. The publication has suggested using self adhesive coatings that have outer surfaces as suggested.

In the document WO2014/016629 solutions were suggested for improving the grip between the shoe surface and the ball by using uncoated rubber granulates, and it was suggested that such grip-improving layers be provided on spaced zones of the surface of the upper of the shoe, and the respective zones should be provided to ensure optimum targeting and ball directing effects. The document has also suggested the utilization of the edges of the coated zones for directing the ball and it has also suggested the use of an appropriate ribbing.

That publication was, however, silent about the actual ways how these objectives can be reached by the arrangement of the surface parts having increased grip to the ball, and suggested only that experiments should be carried out and everyone has to find his/her optimum solution.

The publication WO 2010/055276 concerns how the shooting properties of a sports shoe can be improved, and the use of a plurality of three-layered isles or parts on the upper of the shoe is provided, wherein the layers have different specified elasticity values. These parts have square shapes and placed in rows and columns beside each other with appropriate spacing between them. The publication focuses on the effects of these three-layered parts and not on the shaping of the parts.

The object of the invention is to combine the excellent grip to the ball provided by the prior solutions with the possibility for the players to choose the path of the ball at shooting by a comfortable change of the direction of the shooting foot.

The invention is based on the recognition that players generally know how and by which parts of the shoe the ball should be received and be kicked in a given situation, whereas his objectives can be different depending on the situation itself and he will keep and move his feet in accordance with such intentions. If on the shooting surface of the shoes or on zones of that surface which are important for the player such a pattern is provided which allows with high probability for the player to choose between two shooting directions depending on the position of the foot, then thereby an efficient assistance can be provided for the player, especially if at the same time a maximum grip is ensured between the shoe and the ball.

With the invention a sports shoe has been provided with a pattern facilitating ball handling, wherein the surface of the upper of the sports shoe is divided into a plurality of shooting zones, namely at least into a nose zone, an inner and an outer shooting zone, and at least one of said shooting zones comprises a plurality of parts that extend out from the basic surface of the upper and have elevated outer surfaces that have increased grip to the ball, and these parts are spaced from each other, and according to the invention that parts are directing isles that have elongated shapes resembling to a rhombus or an almond shape and each has a longitudinal central axis at the end of which respective apexes are formed that have angles smaller than 45°, each directing isle has a transverse axis extending where the isle has the highest width, and said apexes are connected with the ends of the transverse axis by respective sides of the directing isle, the oppositely located sides are either straight or being slightly curved but their main directions are either parallel or close only a small angle, and the neighbouring directing isles are arranged so that they are shifted from each other along the direction of their central axes and between corresponding sides of a directing isle and the similarly directed sides of a neighbouring directing isle directing channels are formed that have directions closing with each other an acute angle, and the width of the channels is between 4 and 15 mm, but preferably 6 and 10 mm, and the height of the directing isles from the basic surface is between 0.4 and 3 mm and preferably between 0.6 and 1.5 mm.

In a preferred embodiment out of the two neigbouring directing isles that define a directing channel the forward apex of the rear directing isle is in an intermediate longitudinal position between the rear apex of the frontal one of said directing isles and the end of the transverse axis of this frontal directing isle.

It is preferred if the path of the directing channels defined by a plurality of directing isles arranged in front of each other is slightly curved in the space.

A pattern should comprise preferably directing isles wherein at least one side is curved and has an inflexion.

For optimizing the grip to the ball the directing isles have outer surfaces constituted by a grainy structure having uncoated resilient granules preferably made of rubber, wherein the grain size is between 0.4 and 1 mm.

In that case it is preferred if the grainy structure constituting the outer surface of the directing isles comprises a lower first layer adhered to a basic surface wherein the size of the granules in the first layer lies between about 0.1 and 0.4 mm, and wherein following the mounting of the first layer by and adhesive, the granules of the outer surface is fixed by an adhesive onto the first layer.

The directing isles are preferably made on a sheet material having a rear surface comprising a self adhesive layer and the directing isles are mounted on the upper basic surface of the associated zone by means of said self adhesive layer.

For increased targeting at least a part of the directing isles comprises a ribbing on their outer surfaces.

In that case it is preferred if the ribbing has ribs extending in transverse direction.

The pattern should be structured so that the directing channels defined by neighbouring directing isles in the respective zones constitute the continuation of each other.

It is further preferred if close to the rim of the sole of the sports shoe there are directing isles that extend till and cover said rim.

In certain cases it can be preferred if the height of directing isles located at the rearmost position and/or adjacent to the shoe lace opening increases towards the heel zone and/or towards the shoe lace opening.

The invention will now be described in connection with preferred embodiments thereof, wherein reference will be made to the accompanying drawings. In the drawing.

Figure 3:
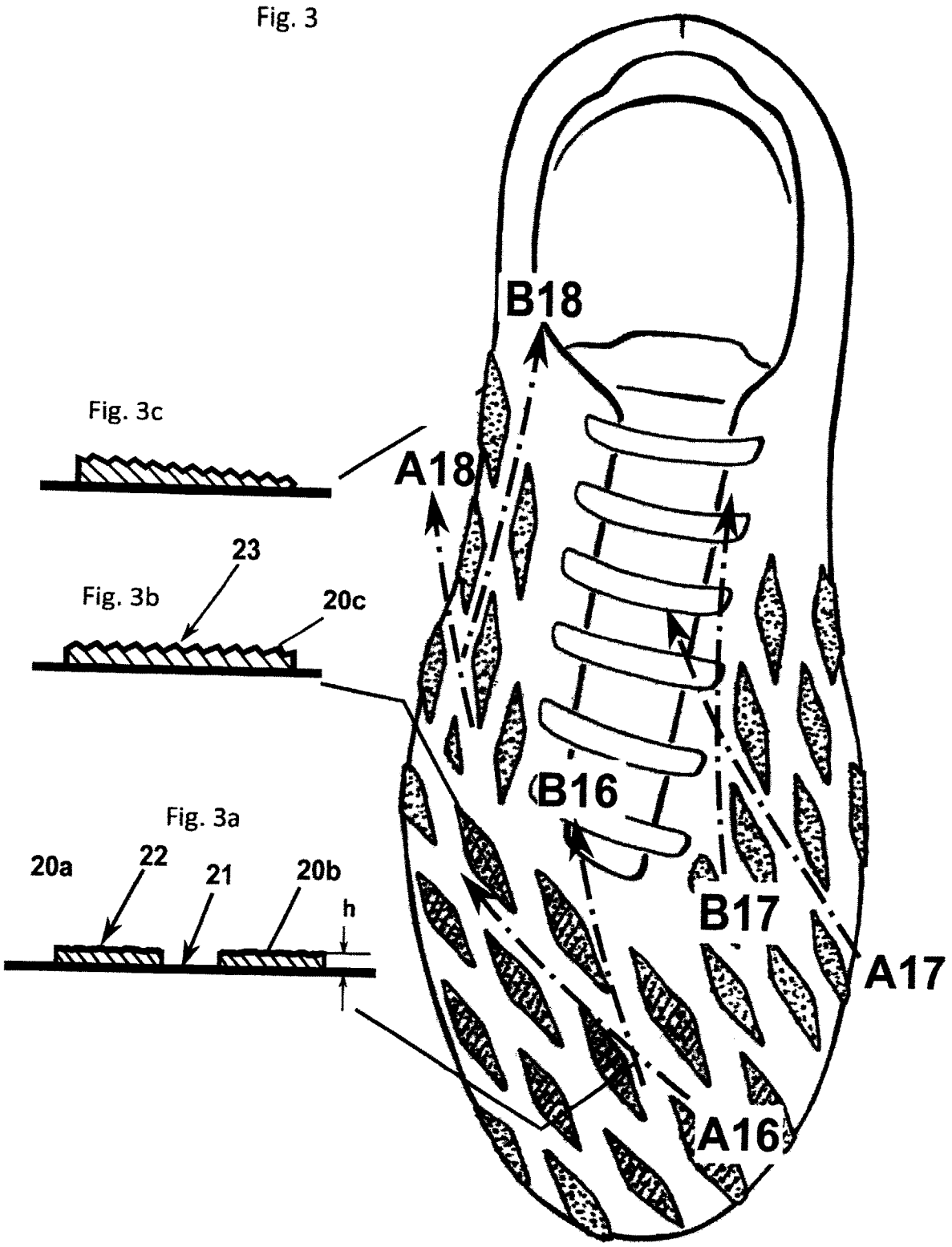
FIG. 3 shows the top view of a right shoe provided with a different pattern.
Figure 4:
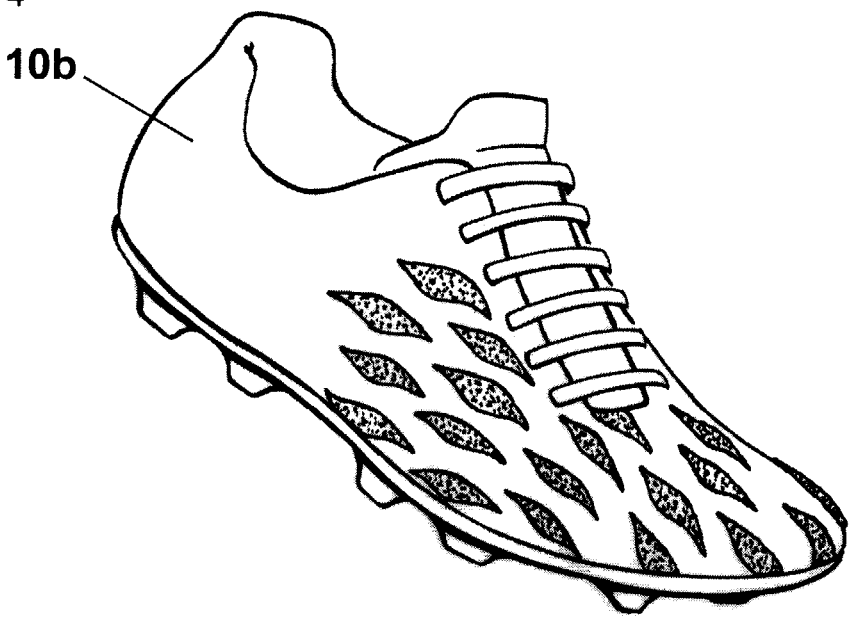
Figure 5:
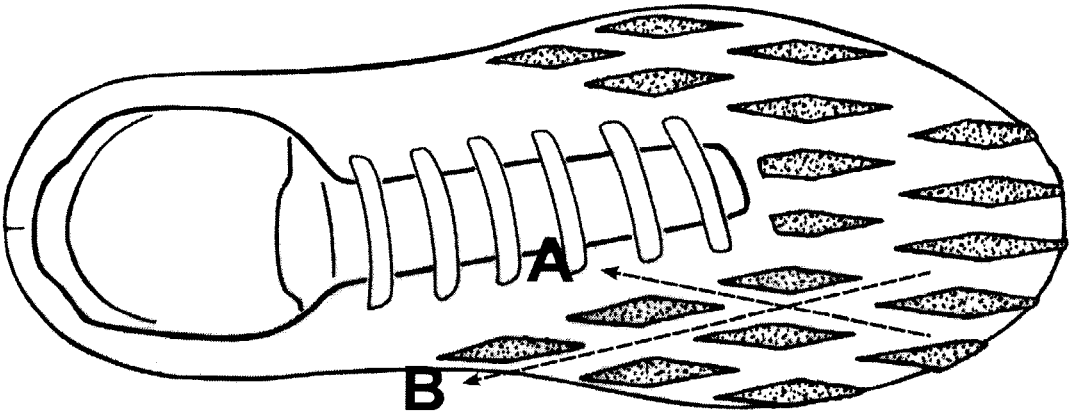

FIG. 3*a* is an enlarged sectional detail taken from the designated part of FIG. 3;

FIG. 3*b* is a section similar to FIG. 3*a* in case of an embodiment with a ribbing;

FIG. 3*c* is a longitudinal sectional detail of a directing isle provided on a rear zone;

FIG. 4 shows the perspective view of a left shoe having a further type of pattern;

FIG. 5 shows the top view of a right shoe having a still further pattern;

FIG. 6 is an enlarged detail of a pattern;

FIG. 6*a* shows the enlarged profile of a directing isle; and

FIG. 7 shows the nose zone with special forward extending directing isles projected obliquely from above and from the frontal direction.

Figure 1:
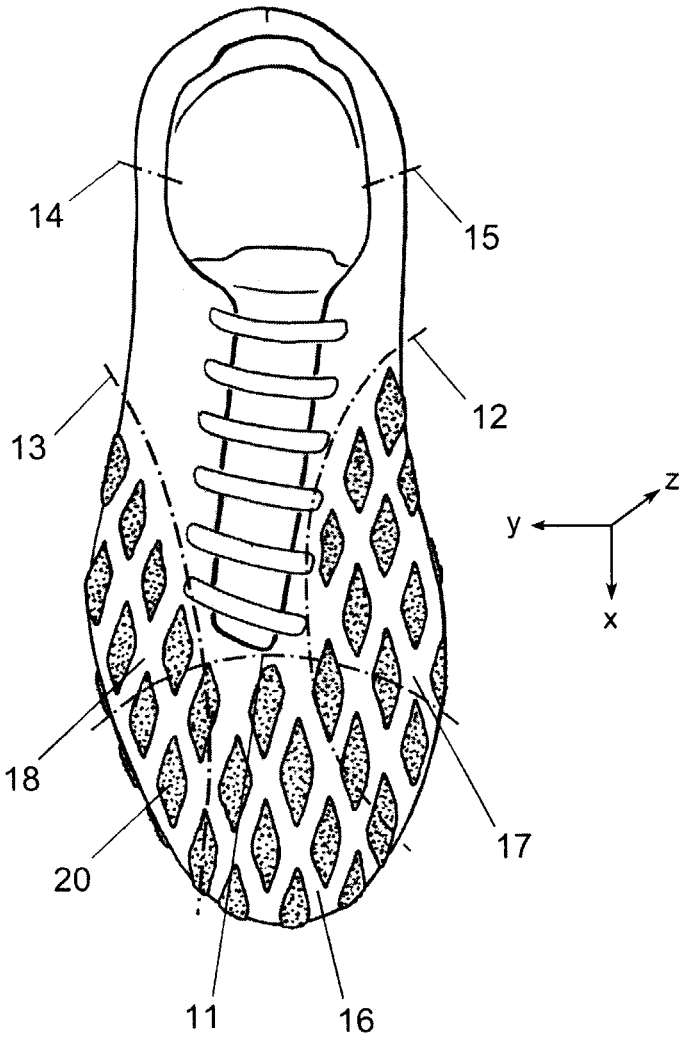
FIG. 1 shows the top view of a right shoe provided with a pattern according to the invention.

FIG. 1 shows the top view of the first embodiment of a sports shoe 10 according to the invention designed for the right foot of a player and provided with directing isles according to the invention. For the sake of simplicity the invention will be described in connection with uses for soccer games but similar principles are true in case of use in futsal, footgolf or even in American football games or in any other uses when a player kicks, passes or handles a ball from any reason.

From the point of view of ball handling the surface of the shoe used for shooting can be divided into a plurality of separate zones between which there can be overlaps and the boundaries of such zones have been schematically illustrated in FIG. 1 by dash-dot lines 11, 12, 13, 14 and 15. In front of the curved, slightly horseshoe-shaped line 11 the area towards the nose of the shoe designates nose zone 16. The line 12 is the boundary of an inner shooting zone 17 and the line 13 is the boundary of outer shooting zone 18 of the shoe. Because the distortion of the top view the lines 14 and 15 appear short, and the zone between them is heel zone 19 that can be divided further into left and right rear zones and their coverage with directing isles is only rarely required.

The boundaries of the respective zones are not sharp lines as the zones transit into each pother in a smooth transition having no sharp boundaries. The players know well and also have experienced how to receive and kick the ball in possible situations during the game. From the point of view of a finer ball handling the mentioned zones can be divided into further parts e.g. frontal, central or rear inner (or outer) zones. In FIG. 1 a coordinate system y, x, z has been illustrated because the player can turn and incline his feet (and his shoes) in all directions in the space, therefore the different curved surfaces of the zones can contact the ball in differing angles and forward it in accordance with the intention of the player. The axis x designates the longitudinal direction of the shoe, the direction y the transverse direction and the direction z the direction normal to the plane of the sole.

On the surface of the shoe 10 special directing isles 20 have been provided which are spaced from each other and their shapes and arrangement follows certain rules. The shape of the directing isles 20 is a spatial form limited by four lines that can be straight or slightly curved and at two of their opposite ends the lines close an acute angle and the two intermediate angles are obtuse angles, the isles 20 follow the curved outer surface of the shoe. When seen in spread view the isles resemble to a diamond shape having straight or slightly curved sides and rounded tips. When the shape should be named, a good approach can be the expression: "almond shape". The arrangement of the directing isles 20 is such that channels with predetermined width are formed between them, and all directing isles 20 are limited by four channels.

Figure 2:
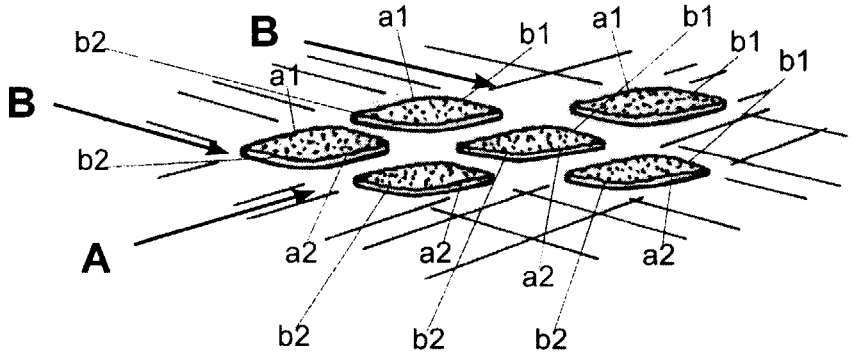
FIG. 2 shows the enlarged perspective view of a detail of the pattern.

Reference is made now to FIG. 2 which shows the perspective view of a pattern comprising six directing isles 20. The respective directing isles have nearly parallel opposite sides a1, a2 and b1, b2. FIG. 6 shows the enlarged sketch of a directing isle 20. The sides a1, a2 and b1 and b2 can also be slightly curved but they can also be straight. The sides a1 and a2 are substantially parallel or there is only a slight angular difference between their directions. In the pattern set by the directing isles 20 the side a1 of a directing isle define together with the side a2 of an oppositely arranged other directing isle the opposite boundaries of a virtual directing channel A. Similarly, the sides b1 and b2 of the neighbouring directing isle define the boundaries of another virtual directing channel B. In FIG. 2 not all sides of every directing isle and not all directing channels were provided with a reference symbol to preserve perspicuity.

It should be noted that the directing channels A and B formed among the directing isles constitute spatial paths and the ball arriving thereto is slightly forced to follow them. The directing channels A and B close with each other just that same acute angle, which is defined between the sides a1, a2 and b1, b2 of the directing isles 20.

The directing isles 20 rise or swell out by a predetermined height from the basic surface of the upper of the shoe and their upper surface is parallel to the surface of the upper of the shoe and they have a design that provides an increased contact with the ball. The height can depend on the size and intended use of the shoe, from the needs of the given player and also from the zone in which it is arranged and from the position taken in the zone, and its value is preferably between 0.4 and 3 mm but more preferred if it is between 0.6 to 1.5 mm and still more preferred is the range between 0.8 and 1.2 mm of height. The extent of the rising out of the directing isles from the outer surface of the shoe defines the height of the respective sides or edges, and owing to the height of the edges of the directing isles and to their resistivity these edges can direct the ball after being contacted thereby. Although the presence of the edges contribute to divert the ball along the channels defined thereby, the contact surface between the ball and the shoe is sufficiently large that the ball contacts mainly and being supported predominantly by the outer surface of the diverting isles 20. This outer surface has preferably a grainy structure, wherein the grains are made from a resilient material like rubber and have irregular shapes and sizes, and the grains are fixed to the underlying surfaces by adhesive bonding. Such surface structures are described e.g. in the previously referred document WO 2014/016629. Although the multi-layered application of the grains is preferred, such is not an indispensable condition at the present invention because the directing isles can be realized also from prefabricated single or multi-layered sheets with the required thickness which should be cut to the required shapes. Such sheets can have self adhesive inner coatings by which they can be placed either separately or by using an appropriate mask or template either when the shoe's upper is manufactured or on the surface of the readymade shoe by applying an appropriate pressure. In such cases on the surface of the semi-finished sheets (before the cutting of the directing isles) a grainy structure can be provided which can have the colour, size and parameters selected in accordance with the intended use in the given zone. Alternatively, the required surface parameters can also be selected from a choice of different types of prefabricated sheets. Instead of using the grainy structure the outer surface can be made by any other type of surface coated by a layer that has an appropriate adhesion (grip) to the ball. The document US 2009/0007457 lists a number of plastic materials that have such an increased grip to the ball.

The directing isles 20 can be provided during the manufacture of the upper of the shoe when the material of the upper is still spread out in a planar sheet, and during that phase there are several ways of placing the pattern composed of directing isles 20 of predetermined shape, height and arrangement e.g. by pressing or by positioning of inserts thereon. It should be noted when the upper is pulled over of the last and a spatial form is taken, in the material distortions, tensions and material extensions take place, and if the directing isles 20 are provided before this manufacturing step it should be ensured that the pattern composed by the directing isles 20 takes the required shape following such distortions i.e. on the final curved surface of the manufactured shoe.

Reference is made now to FIG. 3 which shows the top view similar to FIG. 1 of a different embodiment of the sports shoe. In this embodiment the directing isles 20 from which the pattern is composed are similar to those shown in FIG. 1, however, they are positioned in different angles and in the respective zones the directions of the channels A and B are also different. In the inner shooting zone 17 two important channel directions A17 and B17 are shown that are both slightly curved. If the player turns his corresponding foot into a position that the ball should arrive on the inner shooting zone 17 and it is his intention that during the shooting the ball should take an upwardly inclined path then he will hold his foot in a position that the ball will be received by the directing channel A17. If in contrast to the previous intention the player wishes that the ball should take a flat path, then compared to the previous position he should slightly turn his foot in inward direction around the axis x, and in this case the ball will be received by the directing channel B17 and its angle assists shooting the ball to take a flat path.

At the nose zone 16 the direction of the directing isles 20 closes a higher (more inclined) angle with the longitudinal axis x of the shoe and one can see the two different directions of the directing channels A16 and B16 which influence the path of the ball depending on the angular position how the player holds his foot when he receives the ball and on the angle from which the ball arrives. In the nose zone 16 the longitudinal directions of the directing isles slightly change, therefore compared to the directing channel A16 the next outwardly neighbouring directing channel is slightly more curved, and its line assists primarily passes and shoots where the ball follows a flat but still upwardly inclined curved path.

In the outer shooting zone 18 directing channels A18 and B18 are provided which also define respective slightly curved paths, the channel A18 closes a higher angle with the axis x while the channel B18 is almost parallel to this axis x. It can also be observed in the drawing that the directing channel A18 forms with a practically continuous transition the extension of a directing channel in the nose zone 16. This is why it can be stated that the zones form the continuation of each other and there are no sharp boundaries between them.

It should also be noted that the meeting of the ball and the shoe should not be thought that the ball moves along a full directing channel, but it reaches the surface of at a portion of a directing channel. Depending on the relative angular position of the shoe the ball will generally roll along a comparatively short path along the directing channel where it has arrived, and during shooting the direction of the path will be determined primarily by the edge that contacts the ball and defines the channel and the surface of the neigbouring isles (of course in addition to the dependence from the direction and speed of the movement of the shoe).

When in the present description the effects of the patterns provided on the shoe are mentioned then in the first place the differences compared to conventional designs are mentioned. However, the skill and shooting technique of the player has also determining role in directing the ball, and it is emphasized here only how much the design of the shoe can assist this role and skill.

FIG. 3*a* shows an enlarged line profile of two neighbouring directing isles 20*a* and 20*b* of the nose zone 16 in which one can observe the basic surface 21 of the shoe upper, the height h of the two directing isles 20*a*, 20*b*, the edges constituted by the sides of the isles and outer surface 22 of the diverting isles 20*a*, 20*b* about which it was said that it has a preferably grainy structure with increased grip to the ball.

FIG. 3*b* shows the ribbed design of the outer surface of a directing isle 20*c* which means that in the grainy outer surface 22 of the directing isle 20*c* a ribbing 23 is provided and the ribs and grooves thereof extend preferably parallel with the transversal diameter of the directing isle 20*c*. The ribs of the ribbing 23 are sufficiently wide and deep to divert the ball pressed to the outer surface 22 into a direction which is normal or close to normal to the edge lines of the ribbing 23. The size of the width and depth of the ribbing 23 is between about 0.5 and 1.5 mm. The presence of the ribbing 23 increases the directing effect, however, its use is not mandatory and there is not always a need to design the outer surfaces of all directing isles with respective ribbing. In the exemplary pattern shown in FIG. 3 the surface of the directing isles provided with ribbing was drawn by hatched lines. The lines symbolize at the same time the main directions of the ribs.

FIG. 3*c* shows the enlarged line profile of such a directing isle which is close to the rearmost part of the pattern (i.e. close to the heel) or close to the shoelace opening. In such cases it is preferred if the height of the directing isle is higher or it increases in rearward direction or towards the shoelace opening. The objective of such a design is when the concerned directing isle is made close to the heel it should prevent the ball from reaching the non-patterned part of the shoe, and the slope in forward direction also assists diverting the ball forward. Close to the shoelace opening the increase of thickness decreases the danger that the ball can hit the lace itself because such a hit might result in unwanted reflection of the ball.

Reference is made now to FIG. 4 which shows sports shoe 10*b* made for a left foot. Here the sides defining the shape of the directing isles 20 are curved lines, and in certain cases the sign of the curvature can even change (i.e. the curve has an inflexion). In spite of that it can be seen that the sides of the neighbouring directing isles that define a directing channel have matching curvatures i.e. the width of the directing channels remains the same or does not change substantially although the sides of the isles are not straight. Such a pattern is required primarily for shoes of smaller size (e.g. for children's shoes) because there the shape of the shoe has a greater degree of inclination within small distances and the edges or sides visible on the figure appear more curved owing to the curved surface on which the isles are made. A further characteristic of smaller shoes is the smaller number of directing isles, therefore the sides of each directing isle have greater roles in directing the ball. In FIG. 4 it can be observed that the diverting channels are formed just as described earlier, and a ball arriving at a given portion of the shoe will follow one or the other directing channel depending on the angle how the player holds his foot.

FIG. 5 shows a further embodiment of the pattern according to the invention which is arranged on a sports shoe made for a right foot. In this pattern the shoe fits on a larger foot and the directing isles have straight sides, they are slim and comparatively large, therefore compared with the previously shown embodiments the number of the directing isles is smaller. The angle closed between the directing channels A and B is small, it is around 15°, and the apex angles of the directing angles are also that small.

Of course, the use of sports shoes provided with the patterns according to the invention should be exercised in a thorough way. The exercise and even the gaming itself can be improved if the respective different zones or in special parts of the zones the directing isles are made in different colours. It such a case the task of the coach will be simpler because instead of long explanations it is easier for him to give only the name of the colour in his training instructions in which he plans to suggest the receipt or the shooting of the ball. The players will understand more easily by hearing the name of a colour that in any given playing situation how i.e. with what zone of the shoe they should receive and kick the ball.

There are several possibilities for placing the directing isles 20 on the shoe surface. In FIGS. 6 and 6*a* a simple but efficient way is shown which can be used primarily for shoes that have been made to their final shapes. Before the placement of the directing isles 20 it is advisable to cover the shoe surface at positions where the pattern should not be made by masks. To this end narrow masking tapes can be used which are placed along the planned directing channels A and B. Perhaps more masking tapes can be arranged according to the known rules of spinning. Following the masking step the uncovered areas left between the masks can be covered by directing isles that have good adhesion to the surface. FIG. 6*a* shows the enlarged view of a directing isle 20 wherein the sides thereof can well be observed.

Reference is made now to FIG. 7 showing a detail of the front part of the nose zone 14. A specific property of the directing isles 20*d* arranged there lies in that their frontal ends extend over the shooting surface of the nose zone 14 of the shoe and they are bent downward and cover the edge of the sole of the shoe, whereby if a ball reaches accidentally the edge of the sole of the shoe, then the grainy surface of the directing isle with good grip to the ball would direct the ball in the required direction and would prevent its accidental reflection by contacting the hard rim of the sole. In the pattern according to the invention all of the directing isles where the isles are close to the rim the directing isle are bent downward.

In the examples described earlier it has been demonstrated how many possibilities exist for realizing the directing isles 20 according to the invention and the directing channels between them. Based on the enlarged views of FIGS. 6 and 6*a* the main features of the pattern according to the invention will be summarized. Each directing isle 20 has a pair of opposite apexes 25, 26 closing an acute angle and a central axis 27 interconnecting these apexes which is not necessarily a straight line but close to it. The directing isle 20 has a widest transversal axis 28 extending normal to the central longitudinal axis 27 were the sides a1, b1 and a2, b2 meet that define the "almond" shape. The sides meeting here are either straight and close an obtuse angle with each other or they are curved and have convex curvatures and here i.e. at their meeting points they have respective tangents that extend substantially parallel to the central longitudinal axis 27. Their curvature can change sign here. At the two apexes 25, 26 the angle is generally smaller than 45° and preferably smaller than 30° with a typical range between 15° and 25°. The two acute angles need not be identical but generally there is no substantial difference between them. The length of the central longitudinal axis 27 is about at least twice of the length of the transversal axis 28, but this proportion can take a greater value even between 3 and 4.

In the pattern made by the directing isles 20 the shape of the neighbouring directing isles, the spacing between them in longitudinal and transversal directions and the direction of their central axes 27 can be varied within broad ranges, and this allows that their design can fit to the actual needs of the players. For the formation of the directing channels A and B it is required that certain rules apply concerning the position of the neighbouring directing isles that define these channels (which are shifted relative to each other in the direction of their central axes). The rear apex 25 of the forwardly positioned directing isle and the front apex 26 of the directing isle beside it can be shifted relative to each other along the directing channel, but the front apex 26 of the rear directing isle can take at most the frontal position that reaches the transverse axis of the directing isle in front of it, or it is preferred if that position is not even reached and the front apex 26 terminates before the maximum width of the forwardly positioned isle is reached. These two directing isles can also be shifted in the opposite direction but it also has a limit wherein the front apex 26 of the rear directing isle can be at most at the same longitudinal position along the direction of the channel where the rear apex 25 of the forwardly positioned directing isle lies or the distance between these two apexes can be only very short. Such longitudinally shifted directing isles can be seen e.g. in FIG. 3 in the inner portion of the nose zone 14. A further rule is that the angular difference between the central longitudinal axes of the two directing isles that define a channel should be definitely smaller than the smallest one of the acute apex angles of these directing isles otherwise the two directing channels A and B cannot be formed.

One of the previously referred ways to provide the directing isles 20 is the application of the grains. Such a solution can be made preferably by coating the non masked surfaces of the basic surface 21 of the shoe by an appropriate adhesive and a first layer consisting of rubber granules is applied thereon wherein the size of the granules are between 0.1 mm and 0.3 mm or between 0.1 mm and 0.4 mm. This can be made in such a way that from a mix of rubber granules by means of a sieve first those parts are selected which are smaller than the upper limit of the mentioned size range then by using a second sieve those particles are removed which are smaller than the lower limit of the range. The suggested size range has good adhesion to the planar base surface and the granules are not completely immersed in the thin adhesive layer provided, their outer parts will not be covered by the adhesive. On the top of such a first layer it is advisable to apply a second layer, but here larger granules can be used with a size distribution between about 0.3 and 0.6 mm or 0.3 to 0.8 mm. Prior to the application of the second layer the irregular outer surface of the first layer is covered by a thin layer of adhesive and the mix of larger granules is applied thereon. The bottom of the larger granules extend into the valleys and recesses formed between the granules of the first layer and will contact and adhere along a larger surface to the granules underneath but their outer surfaces remain uncoated. By such a method a coating can be obtained in which the directing isles 20 will have the required thickness. If a greater thickness is required one or more further similar layers can be applied in the same way.

A further way of making the directing isles is the use of sheets having self adhesive bottom surfaces wherein their outer surfaces are coated by the aforementioned layers of granules.

The actual use can be realized in several variations because templates can be prepared that enable the coverage of a whole zone. Such a template should have a flexibility to accurately fit to the curved shoe surface wherein the bottom of the directing isles is covered by a self adhesive layer and the fields in between them can be removed easily, i.e. after the protective foil covering the bottom of the template is removed and the concerned zone is covered by the template then only the directing isles will remain adhered to the shoe surface and at the locations of the directing channels the basic shoe surface remains.

An alternative possibility is to prepare separate self adhering directing isles e.g. in sets and to provide appropriate positioning plans, templates to the users. In case of experienced players the preparation of separate self adhesive directing isles can be sufficient so that the player can arrange them on his shoes according to his personal preferences.

The possibility of the individual application of the pattern has been mentioned only as a preferred option because the pattern according to the invention can be made according to the expected (and experienced) needs of frequently used player's positions, because different patterns are needed for a forward player, a rear guard or a midfield player, or those preferring the right or left sides of the playground, or who prefer different zones. A rather interesting possibility can be that such sports shoes would be sold not in exactly fitting pairs and the players could make their choices between different types of left and rights shoes in the same size.

The pattern according to the invention can be combined with other preferred patterns i.e. it can be sufficient if only a single or only a few zones are provided with the pattern according to the invention and on the remaining surface areas conventional or different preferred designs are used.

Based on the foregoing it can be understood that the pattern using the directing isles according to the invention can be made in a high number of variations matching to the playing styles and needs of the individual players.

The essence of the invention lies in the use of the "almond" shaped directing isles and the system of directing channels formed between the isles which can be realized in a high number of forms.

The invention claimed is:

1. Sports shoe with a pattern facilitating ball handling, wherein the said sport shoe has an upper with a surface that is divided into a plurality of shooting zones, at least into a nose zone (16), an inner shooting zone (17) and an outer shooting zone (18) and at least one of said shooting zones comprises a plurality of parts that extend out from a basic surface (21) of the upper and having elevated outer surfaces (22) that have increased grip to a ball when contacting said outer surfaces, and these parts are spaced from each other, said parts being directing isles (20) characterized in that each of said directing isles (20) has an elongated shape resembling to a rhombus or an almond shape and has a longitudinal central axis (27) at the end of which respective apexes (25, 26) are formed, each directing isle (20) has a transverse axis (28) extending where the isle has the highest width, and said apexes (25, 26) are connected with the ends of the transverse axis (28) by respective sides (a1, a2 and b1, b2) of the directing isle (20), the oppositely located sides (a1, a2 and b1, b2) are either straight or being slightly curved but their main directions are either parallel or close only a small angle, and the sides (a1, b2 and a2, b1) defining said apexes (25, 26) close acute angles smaller than 45°, wherein said directing isles (20) are arranged neighboring each other so that adjacent directing isles (20) are shifted from each other along a direction of their longitudinal central axes (27) at most by the half length of said longitudinal central axes (27), and between corresponding side (a2) of any given directing isle and similarly directed sides a1 of a first neighboring directing isle a first directing channel (A) is formed and between another side (b2) of said given directing isle and a similarly directed side (b1) of a second neighboring directing isle a second directing channel (B) is formed, the directing channels (A, B) closing an acute angle with each other corresponding to said acute angle defined between said sides that define said apexes, and the channels having a maximum width between 4 and 15 mm, and the directing isles (20) having a maximum height measured normal to the basic surface (21) between 0.4 and 3 mm.

2. The sports shoe as claimed in claim 1, wherein out of the two neighboring directing isles that define one of said directing channels, a forward apex (26) of the rear directing isle is in an intermediate longitudinal position between a rear apex (26) of the frontal one of said directing isles and the end of the transverse axis (28) of this frontal directing isle.

3. The sports shoe as claimed in claim 1, wherein at least one of said directing channels defined by a plurality of directing isles arranged in front of each other is slightly curved.

4. The sports shoe as claimed in claim 1, wherein at least one of said directing isles (20) has at least one side that is curved and has an inflexion.

5. The sports shoe as claimed in claim 1, wherein at least one of the directing isles (20) have an outer surface (22) constituted by a grainy structure having uncoated resilient granules wherein the grain size is between 0.4 and 1 mm.

6. The sports shoe as claimed in claim 5, wherein the grainy structure constituting the outer surface (22) of said at least one directing isle (20) comprises at least one layer adhered to said basic surface (21) wherein granules in said layer have a size between about 0.1 and 0.4 mm.

7. The sports shoe as claimed in claim 1, wherein said directing isles (20) are made on a sheet material having a rear surface comprising a self adhesive layer.

8. The sports shoe as claimed in claim 1, wherein at least a part of said directing isles (20) comprises a ribbing (23) on their outer surfaces (22).

9. The sports shoe as claimed in claim 8, wherein the ribbing (23) has ribs extending in transverse direction to the longitudinal central axis (27).

10. The sports shoe as claimed in claim 1, wherein the directing channels defined by neighboring directing isles (20) in the respective zones (16, 17, 18) being arranged in continuation of each other.

11. The sports shoe as claimed in claim 1, wherein said sports shoe has a rim and comprises directing isles (20*c*) that extend till said rim.

12. The sports shoe as claimed in claim 1, wherein said sports shoe has a shoe lace opening and the height of directing isles located at the rearmost position and/or adjacent to the shoe lace opening increases towards the heel zone (19) and/or towards the shoe lace opening.

13. The sports shoe as claimed in claim 1, wherein said the maximum width of the channels is between 6 and 10 mm.

14. The sports shoe as claimed in claim 1, wherein the height of the directing isles (20) measured normal to the basic surface (21) is between 0.6 and 1.5 mm.

15. The sports shoe as claimed in claim 5, wherein said granules are made of rubber.

* * * * *